United States Patent [19]

Forberg

[11] Patent Number: 4,791,735

[45] Date of Patent: Dec. 20, 1988

[54] METHOD FOR DRYING OR COOLING PARTICULATE MATERIALS, AND AN ARRANGEMENT IN A MIXING MACHINE

[76] Inventor: Halvor Forberg, Hagabakken 2 Hegdal, N-3250 Larvik, Norway

[21] Appl. No.: 879,861

[22] Filed: Jun. 27, 1986

[30] Foreign Application Priority Data

Jul. 3, 1985 [NO] Norway ..... 852668

[51] Int. Cl.[4] ..... F26B 11/12

[52] U.S. Cl. ..... 34/181; 366/149; 366/300; 34/166

[58] Field of Search ..... 34/166, 179, 180, 181; 366/147, 149, 300

[56] References Cited

U.S. PATENT DOCUMENTS

| | | | |
|---|---|---|---|
| 637,903 | 11/1899 | Stanley | 34/181 |
| 767,158 | 8/1904 | Leyer | 34/166 |
| 1,363,230 | 12/1920 | Clark | 34/181 |
| 2,459,951 | 1/1949 | Metzner | 34/166 |
| 3,632,974 | 1/1972 | Cowlard | 34/166 |
| 3,909,958 | 10/1975 | Castanoli | 34/180 |
| 4,109,394 | 8/1978 | Hoyt | 34/57 B |
| 4,476,686 | 10/1984 | Madsen et al. | 366/147 |

*Primary Examiner*—Henry A. Bennett
*Attorney, Agent, or Firm*—Ralph H. Dougherty

[57] ABSTRACT

The invention relates to a method for drying or cooling particulate materials in a machine where said particles are made to circulate, with a particle flow moving downwards along the inside of a chamber wall. The method is characterized in that a cooling or drying agent, or the like is introduced from above into the interface area between the particle flow directed downwards and the chamber wall.

2 Claims, 1 Drawing Sheet

METHOD FOR DRYING OR COOLING PARTICULATE MATERIALS, AND AN ARRANGEMENT IN A MIXING MACHINE

The present invention relates to a method for drying or cooling particulate materials in a machine wherein the particles are made to circulate with a particle flow downwards along the inside of a chamber wall.

The invention also relates to an arrangement in a mixing machine comprising horizontal vane aggregates, units, or assemblies rotating outwards in opposite directions in a mixing chamber for cooling, drying or the like of the material during said mixing operation.

When particulate materials are mixed it may be desired to dry said materials during the mixing operation. It may also be required to cool the material during said mixing operation, or a combination of cooling and drying may be required.

According to the inventin direct cooling, drying, or the like is proposed by the aid of a suitable medium, e.g. warm or cold air.

According to the invention it is proposed that a suitable cooling agent or drying agent be introduced from above in the interface area between the particle flow directed downwards and the chamber wall.

It is also proposed, advantageously, to provide a vacuum for removing said medium by suction in the area above the rising particle flow in said circulating flow.

According to the invention a device as mentioned above is also improved by means for supplying a cooling or drying agent, or the like downwards along the inside of the mixing chamber walls, said means being provided opposite the vane aggregate vanes that feed in a adjacent the chamber walls. In the area above and between said vane aggregates a discharge means may advantageously be provided.

In a preferred, practical embodiment of the device a channel opening downwards and being connected with a supply conduit for said medium is provided along said inside of the mixing chamber wall or walls, respectively. In an advantageous further development of the invention said channel may comprise a channel wall that is inclined in the channel cross section for guiding said medium towards the inside of said mixing chamber wall.

By the aid of the present invention direct cooling, drying, or the like of the material is achieved during the mixing operation. The supplied medium may, e.g. be hot air when drying is required. In case of an undesired increase of temperature in the mixing machine, the supplied medium may e.g. advantageously be cold air. Supply of a gaseous medium, e.g. air, can also have the effect that said medium forms a lubricant between particles in connection with cooling/drying.

Figure 1:
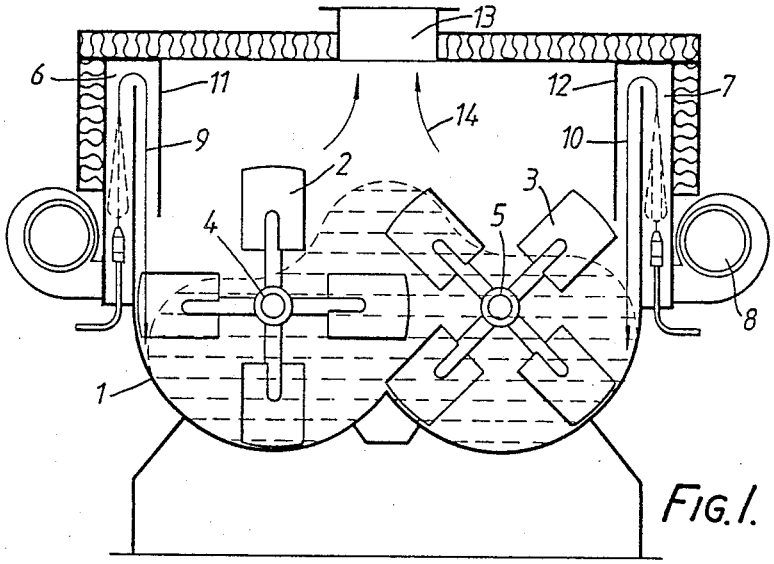
Figure 2:
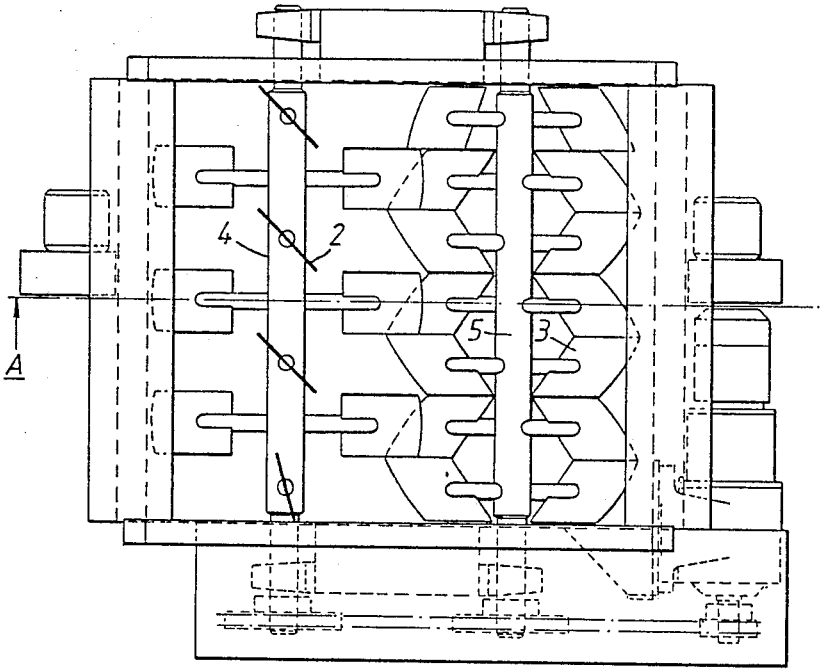

The invention is disclosed in more detail below with reference to the drawings, in which:

FIG. 1 is a diagrammatical end view of a mixing machine wherein the present invention is implemented, and FIG. 2 shows a diagrammatical plan view of the machine of FIG. 1.

As mentioned, the drawings are diagrammatical and only show the components that are necesssry for understanding the invention.

In a mixing chamber 1, two vane aggregates or assemblies 2 and 3 comprise a pair of horizontally-oriented shafts 4 and 5 carrying the vanes, which extend outwardly therefrom. Said vane aggregates 2, 3 rotate in opposite directions about there associated shafts 4 and 5, respectively, as indicated by the arrows. Particulate material to be mixed will, thus, move in two circulations in said mixing machine with a particle flow each moving down along the inside of the mixing chamber walls respectively opposite each vane aggregate.

Uppermost at each mixing chamber wall a channel 6 and 7, respectively, is provided extending along said mixing chamber wall and opening downwards. Channels 6, 7 extend along the entire length of said mixing chamber, as shown in phantom in FIG. 2, and both channels 6, 7 are in the shown embodiment connected with a common supply conduit 8 for a suitable cooling or drying agent, e.g. air. The supplied medium will flow along the respective channel 6, 7 downwards and outwards along the mixing chamber walls, as indicated by arrows 9, 10. Each channel 6, 7 is provided with a channel wall 11, 12 that is inclined in the channel cross section and is intended for guiding the supplied medium towards the inside of the mixing chamber wall.

Above said vane aggregates 2, 3 a discharge means 13 is shown in the shape of a ventilator in the shown embodiment. It serves to discharge gases rising from the material centrally in the mixing container, as indicated by arrows 14.

Having described my invention, I claim:

1. A machine for mixing particulate materials, comprising: a mixing chamber having side walls, end walls, and a bottom; a pair of vane assemblies, each comprising a multiplicity of vanes mounted on horizontally oriented shafts within said mixing chamber and adapted for opposed rotation, said vanes being movable downwardly adjacent the chamber wall; means adjacent said chamber and said side walls parallel to said shafts for introducing a gaseous medium to the interior of said chamber, comprising an elongated chamber forming an elongated passageway extending substantially the length of each of the chamber said walls, said passageway being open downwardly along the length of said passageway for guiding said gaseous medium upwardly along at least a portion of the outside of said chamber side wall and then downwardly along the inside of said chamber side wall, said channel communicaing with a source of gaseous medium.

2. A mixing machine according to claim 1, further comprising gas removal means in said chamber above and between said vane assemblies.

* * * * *